United States Patent [19]

Le Chatelier

[11] 4,238,920

[45] Dec. 16, 1980

[54] DEVICE FOR REVOLVING-RING SPINNING

[75] Inventor: Jacques Le Chatelier, Riedisheim, France

[73] Assignee: Societe Alsacienne de Constructions Mecaniques de Mulhouse, France

[21] Appl. No.: 33,422

[22] Filed: Apr. 26, 1979

[30] Foreign Application Priority Data

May 9, 1978 [FR] France ..... 78 13619

[51] Int. Cl.[3] ..... D01H 7/56

[52] U.S. Cl. ..... 57/124; 57/122

[58] Field of Search ..... 57/119, 120, 122, 124

[56] References Cited

U.S. PATENT DOCUMENTS

| | | | |
|---|---|---|---|
| 3,324,643 | 6/1967 | Kluttz | 57/124 |
| 3,481,131 | 12/1969 | Chilpan | 57/124 |
| 3,664,112 | 5/1972 | Netti et al. | 57/124 X |
| 4,023,342 | 5/1977 | Schenkel | 57/124 |
| 4,095,402 | 6/1978 | Yamaguchi et al. | 57/124 |

FOREIGN PATENT DOCUMENTS

| | | | |
|---|---|---|---|
| 2332029 | 1/1975 | Fed. Rep. of Germany | 57/124 |

*Primary Examiner*—Donald Watkins

*Attorney, Agent, or Firm*—Holman & Stern

[57] ABSTRACT

Each revolving ring of a continuous-spinning frame for textile yarn is mounted on a fluid bearing and driven in rotation by a ring traveler. The resisting torque of the ring is intentionally increased by means of hollow or projecting portions such as fins formed on the ring in order to produce a difference in speed between the normal speed of rotation of the spindle and the speed of rotation of the ring. The result thereby achieved is to ensure uniform tension of the yarn and to improve operating stability of the spinning frame.

8 Claims, 7 Drawing Figures

50
40
30
20
10
8000
10000
12000
14000
48
46
48'
44
G
46'
H
44'
42
42'
Δω=2300 t
Δω=480 t
Δω=500 t

DEVICE FOR REVOLVING-RING SPINNING

BRIEF SUMMARY

This invention relates to the textile industry and is directed to a method and a device for spinning by means of revolving rings.

In conventional continuous-spinning frames, the yarn-guide traveler slides on a fixed ring, thus causing rapid wear of the travelers and relatively high tension of the yarn, which has the effect of setting a limitation on the spindle speed.

In order to overcome these disadvantages, it has already been proposed to make use of revolving rings, especially rings mounted on air-film fluid bearings. A spinning ring of this type has been described, for example, in German Pat. No. 1,195,207 in which the ring is driven in rotation solely by the traveler. By means of an arrangement of this type, the speed of rotation of the ring after an initial period of start-up and acceleration under the action of friction of the traveler becomes equal to the speed of rotation of the traveler by virtue of the practically zero friction of the fluid bearing, with the result that there is no further relative motion between the traveler and the ring. In order to obtain a reduction in yarn tension which permits a high spindle speed and in order to eliminate problems relating to wear of travelers, the need to ensure that the traveler and the ring both rotate at the same speed had accordingly been recognized. For example, in French Pat. No. 74 41 171 which related to a revolving ring rotatably mounted on an aerodynamic fluid bearing, it was even proposed to fix the traveler on the ring.

However, the present Applicant has observed that, although the use of rings rotatably supported on fluid bearings does offer some of the advantages which are sought (namely a very appreciable increase in spindle speed, a reduction in yarn breaks, elimination of wear of travelers), there appeared on the other hand certain disadvantages which are inherent in this type of ring, especially harmful instability of tensile stress on the thread which in turn gave rise to instability of the "balloon".

Although formal reasoning led to the acknowledged conclusion that the relative velocity between traveler and ring should be zero (that is to say, during operation of the spindle and of course after the periods corresponding to start-up), the present Applicant has come to the conclusion, on the contrary, that this synchronization between traveler and ring should be avoided.

The invention has for its object a method of ring-frame spinning, and especially a method in which each spinning ring is rotatably supported on a fluid bearing, which consists in intentionally producing a difference in velocity $\Delta\omega$ between the revolving ring and the spindle.

Preferably, a difference in velocity $\Delta\omega$ within the range of 4 to 16% of the spindle speed is thus produced.

A first embodiment of the method according to the invention consists in intentionally increasing the resisting torque of the ring. In particular, provision can be made on the ring for projecting portions such as fins, for example, which produce an aerodynamic braking action on the ring and accordingly prevent this latter from attaining a speed at which it rotates in synchronism with the traveler.

In a second embodiment of the method according to the invention, use is made of a traveler having a portion which is applied against the ring with a very low coefficient of friction so that the traveler always slides on the ring and is not capable of bringing the ring up to the speed of synchronization with the spindle in spite of the low values of friction within the fluid bearing of the ring.

The two embodiments of the method can be applied conjointly.

BRIEF DESCRIPTION OF THE SEVERAL VIEWS OF THE DRAWING

A more complete understanding of the invention will be gained from the following detailed description and from the accompanying drawings in which a number of embodiments of the invention are illustrated by way of example without any limitation being implied, and in which.

DETAILED DESCRIPTION

Figure 1:
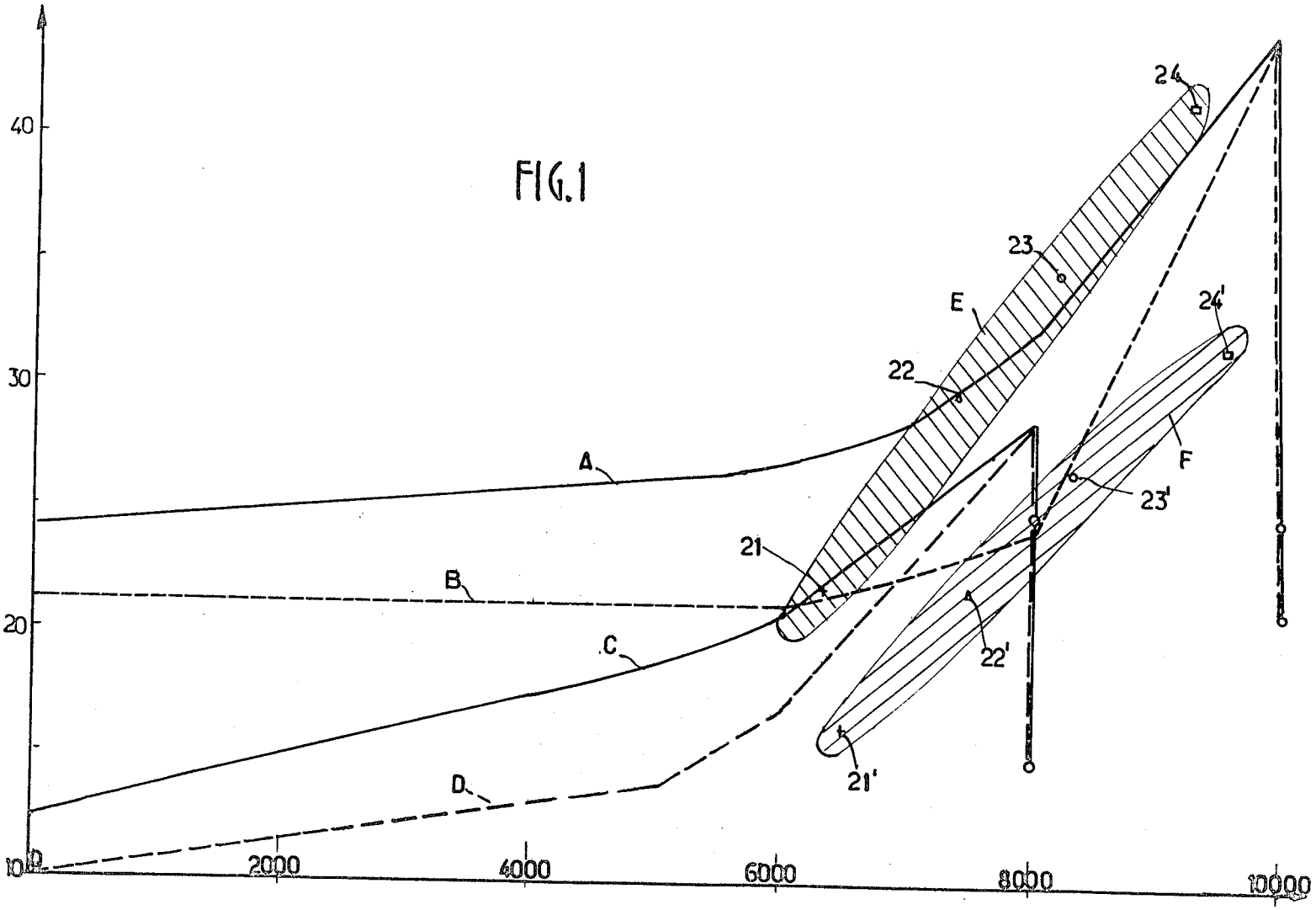
FIG. 1 is a comparative experimental graph of yarn tensions as a function of ring speeds in the case of a conventional ring rotatably supported on a fluid bearing and of a revolving ring for the application of the present invention.

In FIG. 1, the curves A-B-C-D show the variations in yarn tension in grams as a function of the speed of the ring in the case of a revolving ring of the fluid bearing type which operates in the conventional manner, that is to say in which the speeds of the ring and of the traveler are synchronized after the start-up period. The curves A and B relate to a spindle speed of 10,000 rpm whilst the curves C and D relate to a speed of 8,000 rpm. The curves A and C indicate the tensions when the yarn is wound onto the small diameter of the bobbin whilst the curves B and D indicate the tensions when the yarn is wound onto the large diameter of the bobbin.

It is apparent from curves A and B that the yarn tension increases at a uniform rate during the start-up period, then at a higher rate above approximately 6,000 rpm and finally reaches a maximum value (of approximately 45 grams during the test) when the ring practically attains the speed of synchronism. The progressive increase in tension arises from the fact that the coefficient of friction of the pair constituted by traveler and steel ring tends to increase when $\Delta\omega$ tends to zero at the same time as it proves necessary to accelerate the ring. At this moment, there takes place a sudden reduction in yarn tension (from 45 g to 25 g or 21 g, depending on whether the yarn is wound onto the small diameter or the large diameter of the bobbin) since the tension again falls to a minimum value when the acceleration is zero.

In the case of a spindle speed of 8,000 rpm (curves C and D), the phenomenon is identical and the yarn tension suddenly drops when synchronism is attained at a ring speed of 8,000 rpm, from 29 g to 15 g. This phenomenon arises from the fact that the traveler must no longer supply the necessary energy for acceleration of the ring but only in order to overcome the low values of friction of the ring within its air-film bearing. Since the speed of the ring and the speed of the traveler are synchronized, the friction force applied by the traveler on the ring is practically zero, with the result that the tension exerted on the yarn falls to a minimum.

This sudden reduction in yarn tension which takes place in synchronism has a disadvantage in that it produces an adverse effect on the balloon which becomes unstable.

One of the means in accordance with the invention for preventing the ring from attaining the speed of synchronism consists in providing on said ring either hollow or projecting portions disposed substantially in a radial direction or with at least one radial component.

Figure 2:
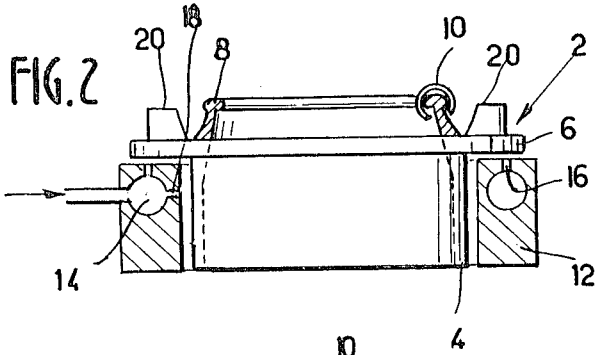
FIG. 2 is a part-sectional view in elevation showing a revolving ring provided with the improvements according to the invention.

In FIG. 2, there is shown by way of example a revolving ring supported on a fluid bearing of the type which is fed by an external supply of compressed air.

The ring 2 comprises a cylindrical tubular skirt 4, a peripheral annular flange 6, a traveler rail 8 and a traveler 10. In accordance with known practice, the ring is centered and lifted with respect to a stator 12 provided with a manifold 14 for the admission of compressed air and nozzles 16–18 for the discharge of compressed air into the leakage gap between the stator and the ring.

In accordance with the invention, provision is made for a plurality of fins 20 (three or six fins, for example) which are fixed on the ring. The design function of said fins is to set up an aerodynamic resistance which increases substantially with the square of the speed of rotation of the ring.

In FIG. 1, the shaded zones E and F indicate the operating zones (respectively for winding of the yarn onto the small diameter and onto the large diameter of the bobbin) of a spinning ring in accordance with the invention, said ring being provided with three fins such as those illustrated in FIG. 2.

In the zones E and F aforesaid, the points 21, 21'–22, 22'–23, 23'–24, 24' correspond respectively to spindle speeds of 10,000, 12,000, 13,000 and 14,000 rpm. It is apparent from FIG. 1 that the yarn tension progressively increases but is not attended by the sudden reduction in tension which is observed in the case of known rings.

Figure 3:
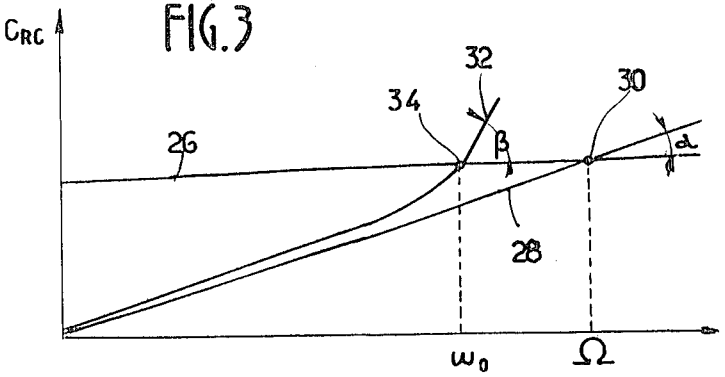
FIG. 3 is a theoretical comparative graph in which the method of spinning with a conventional revolving ring is compared with the method according to the invention.

The present invention makes it possible not only to prevent sudden variations in yarn tension during transient periods but also to improve the stability of the balloon during operation. This result is illustrated in FIG. 3, in which the curve 26 indicates, as a function of the speed of rotation, the resisting torque of the traveler with respect to the ring (CRC) and the curve 28 indicates the resisting torque of the ring (CRA) in the case of a conventional fluid-bearing spinning ring. The operating point 30 is plotted in respect of a ring speed in the vicinity of the spindle speed $\Omega$ (synchronism). By virtue of the fact that the curves 26 and 28 intersect at a small angle $\alpha$, it is apparent that the operating point will have low stability and that small random variations in CRC or CRA will give rise to substantial variations in ring speeds.

On the contrary, in accordance with the present invention, the resisting torque of the ring is a function of the square of the speed by virtue of the presence of the fins as shown by the curve 32 which intersects the curve CRC at an angle $\beta$ which is much larger than the angle $\alpha$ at a point of equilibrium 34 corresponding to a speed $\omega_0$ of the ring which is appreciably lower than the speed of synchronism $\Omega$, thereby achieving enhanced stability of operation.

Figure 4:
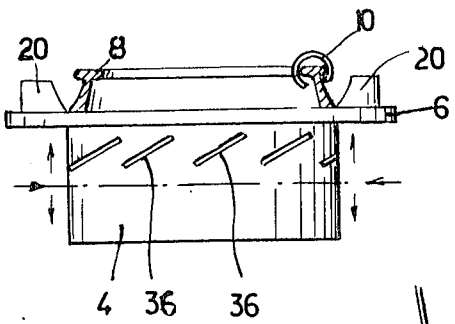
FIG. 4 illustrates a revolving ring in accordance with another embodiment of the invention.
Figure 5:
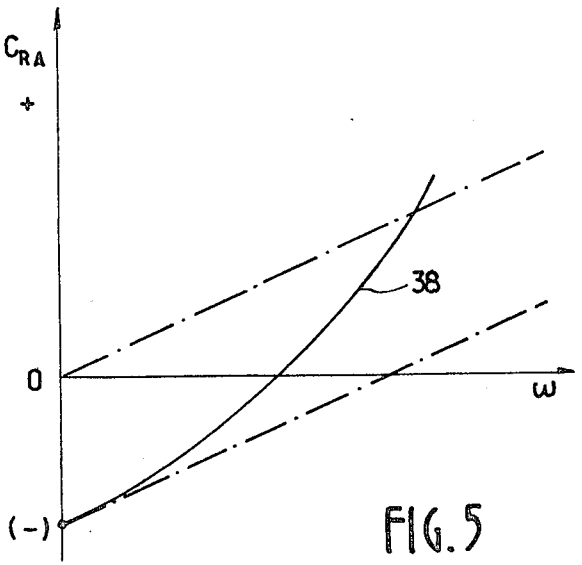
FIG. 5 is a curve showing the resisting torque of the ring of FIG. 4 as a function of its speed of rotation.

In FIG. 4, there is shown an alternative embodiment of the invention in which the ring is provided with grooves 36 in addition to the fins, said grooves being formed in the skirt 4 of the ring. The resisting torque of a ring of this type is represented by the curve 38 in FIG. 5, the curvature of which is similar to that of the curve 32 of FIG. 3. It should be noted that, in the case of low speeds of rotation, the resisting torque of the ring is negative by reason of the orientation and arrangement of the grooves 36 within the leakage gap of the fluid bearing.

A suitable choice of the number, size and shape of the fins 20 and even of the grooves 36 makes it possible to obtain the most favorable relative velocity $\Delta\omega$ between traveler and ring while remaining sufficiently far from synchronism to avoid the problems of instability which were mentioned earlier.

Figure 6:
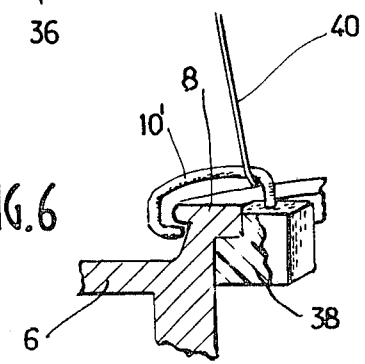
FIG. 6 is a part-sectional view in perspective showing a spinning ring with a traveler in which a portion of the traveler is applied against the ring with a low coefficient of friction.

In another embodiment of the invention, use is made of a traveler 10' (shown in FIG. 6) having a frictional contact portion 38 formed of material having a very low coefficient of friction, for example a synthetic material of the type which is marketed under the tradenames of "Teflon", "Delrin", low-friction loaded "Nylon".

In the case of revolving rings mounted on fluid bearings in which the ring is driven in rotation solely by the traveler, that is to say by the thread 40 which passes through said traveler, it had been considered preferable up to the present time to employ travelers which had a relatively low capacity for sliding with respect to the ring. It had in fact been found desirable to drive the ring by frictional contact as rapidly as possible up to the speed of synchronism and it had even been proposed to fix the traveler on the ring. On the contrary, the present Applicant has reached the conclusion that, with a traveler having a very low degree of friction, said traveler was incapable of pulling the ring up to the speed of synchronism and that there therefore always existed a difference in speed between the ring and the spindle.

Since there exists a relative speed $\Delta\omega$, the traveler performs frictional work which results in yarn tension and prevents the sudden variations in tension which were mentioned earlier in the description.

Figure 7:
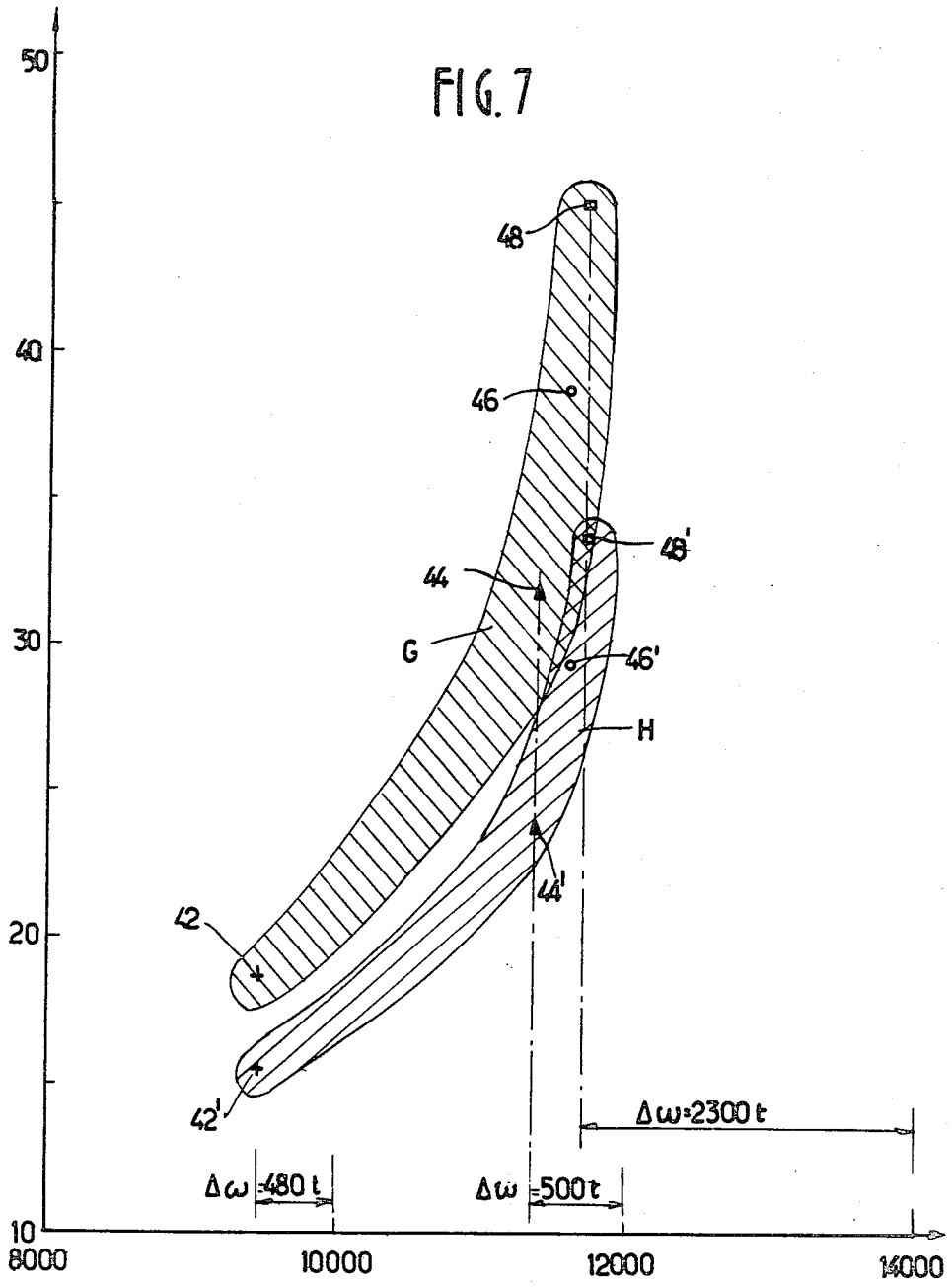
FIG. 7 is a graph showing the yarn tensions as a function of the ring speeds in respect to different spindle speeds.

FIG. 7 shows the results obtained with a 30 mg traveler having a frictional-contact portion of synthetic material which has a very low coefficient of friction. The ring employed is not provided with fins. The shaded zone G corresponds to winding of the yarn onto the small diameter of the bobbin whilst the zone H corresponds to winding of the yarn onto the large diameter of the bobbin. The speeds of the ring in rpm have been plotted as abscissae and the yarn tensions in grams have been plotted as ordinates.

The points 42—42', 44—44', 46—46', 48—48' have been plotted respectively in respect of spindle speeds of 10,000, 12,000, 13,000 and 14,000 rpm. The results recorded in FIG. 7 are as follows:

| Spindle speed | Ring speed | $\Delta\omega$ |
|---|---|---|
| 10,000 rpm. | 9,520 rpm. | 480 rpm. |
| 12,000 | 11,500 | 500 |
| 13,000 | 11,600 | 1,400 |
| 14,000 | 11,700 | 2,300 |

The relative speeds which produce the best results are within the range of 4% to 16% of the spindle speed. It is worthy of note that the yarn tension increases progressively without ever showing a tendency towards a sudden reduction which would result in instability.

As can readily be understood, both embodiments of the invention can be employed conjointly on the same spinning ring such as, for example, a finned ring and a traveler having a low coefficient of friction, the characteristics of the fins and of the traveler being chosen so as to obtain the desired relative speed.

What is claimed is:

1. A spinning or twisting device comprising an annular support, a rotary ring, a fluid bearing arranged on said annular support for supporting said rotary ring for rotation, and a traveler slidably engaged on said rotary ring and effecting rotation of said ring, wherein controlling means are provided for obtaining a predetermined differential rotational speed between said rotary ring and said traveler.

2. A device as set forth in claim 1, wherein said controlling means comprise aerodynamic self-braking means on said rotary ring.

3. A device as set forth in claim 2, wherein said aerodynamic self-braking means comprises projecting portions provided on said ring.

4. A device as set forth in claim 2, wherein said aerodynamic self-braking means comprises hollow portions cut into said ring.

5. A device as set forth in claim 3, wherein said projecting portions comprise radial fins carried by said ring.

6. A device as set forth in claim 4, wherein said hollow portions comprise grooves cut into the ring at an angle with respect to the circumferential direction of said ring.

7. A device as set forth in claim 1, wherein said controlling means comprise a portion of said traveler which is slidably engaged on said rotary ring being made of a synthetic material having a low coefficient of friction.

8. A device as set forth in claim 7, wherein said synthetic material is polytetrafluoroethylene.

* * * * *